United States Patent [19]

Oppenberg et al.

[11] Patent Number: 4,575,332

[45] Date of Patent: Mar. 11, 1986

[54] METHOD OF AND BURNER FOR BURNING LIQUID OR GASEOUS FUELS WITH DECREASED $NO_x$ FORMATION

[75] Inventors: Rolf Oppenberg, Wesel; Helmüt Wiehn, Oberhausen, both of Fed. Rep. of Germany

[73] Assignee: Deutsche Babcock Werke Aktiengesellschaft, Oberhausen, Fed. Rep. of Germany

[21] Appl. No.: 624,712

[22] Filed: Jun. 26, 1984

[30] Foreign Application Priority Data

Jul. 30, 1983 [DE] Fed. Rep. of Germany ..... 3327597

[51] Int. Cl.[4] ..... F23M 3/00

[52] U.S. Cl. ..... 431/9; 431/4; 431/10; 431/116; 431/351; 431/183; 431/188

[58] Field of Search ..... 431/9, 10, 115, 116, 431/174, 175, 181–183, 188, 351

[56] References Cited

U.S. PATENT DOCUMENTS

| | | | |
|---|---|---|---|
| 2,918,117 | 12/1959 | Griffin | 431/116 |
| 4,004,875 | 1/1977 | Zink et al. | 431/187 |
| 4,130,388 | 12/1978 | Flanagan | 431/116 |
| 4,347,052 | 8/1982 | Reed et al. | 431/188 |
| 4,380,429 | 4/1983 | LaHaye et al. | 431/115 |

*Primary Examiner*—Carroll B. Dority, Jr.
*Attorney, Agent, or Firm*—Max Fogiel

[57] ABSTRACT

To allow liquid and/or gaseous fuels to be burned with decreased $NO_x$ formation, the combustion air is fed in at axial intervals one after the other. The percentage of primary air is higher than that of secondary air. The injector effect of the primary air draws flue gas out of the firebox and supplies it to a flame-initiation point between the primary-air and secondary-air feeds.

24 Claims, 5 Drawing Figures

METHOD OF AND BURNER FOR BURNING LIQUID OR GASEOUS FUELS WITH DECREASED $NO_x$ FORMATION

BACKGROUND OF THE INVENTION

The present invention relates to a method of and a burner for burning liquid or gaseous fuels in a firebox with a decreased formation of $NO_x$, whereby the combustion air is supplied in portions in the form of primary and secondary air, the portions are fed in one after the other at axial intervals parallel to the flow of the combustion gases, and the primary air generates an injector effect that draws combustion gases in.

The combustion air in a burner of this type can be fed in in component currents with the combustion in an initial combustion section being reducing. The combustion air in known pulverized-coal burners is supplied through concentric channels with their exit cross-sections essentially in the same plane (*Jahrbuch der Dampferzeugungstechnik,* 4th Ed., 1980, 81, pp. 748–763). Decreasing the content of $NO_x$ by recirculating flue gas and mixing it with all or part of the combustion air is also known (DE OS No. 2 306 537 and DE OS No. 3 110 186).

The use of a burner of this type, with air-channel exits in the same plane, as a gas or oil burner resulted in an essentially slighter decrease in $NO_x$ content than that obtained with a pulverized-coal burner. Obviously, the proportions of the gas or oil flame in the burner were not affected as much by the discontinuous supply of air in the same exit place as in a pulverized-coal flame.

An oil burner in which the component currents of combustion air are supplied at intervals along the axis of the burner is known (U.S. Pat. No. 4,004,875). Since the proportion of primary air in that device is lower than that of secondary air, an initial flame can become established with insufficient ultraviolet radiation. Some of the incompletely burned reaction products that occur in the primary combustion section of the burner are also drawn back and returned to that section. These incompletely burned gases lead as the result of cooling and flow-dependent deposition to coke caking and contamination inside the burner. The known burner is accordingly inappropriate for burning heavy heating oil.

SUMMARY OF THE INVENTION

The object of the present invention is to provide a method of and a burner for burning liquid and/or gaseous fuels, by means of which the formation of $NO_x$ during combustion can be effectively suppressed, whereas the flame can be unobjectionably monitored and the burner will not be contaminated.

This object is attained first in accordance with the invention by means of a method of the aforesaid type, characterized in that the primary air is supplied in a percentage of the total combustion air that is higher than that of the secondary air and in that extensively burned combustion gases are drawn out of the firebox and conducted to a flame-initiation point between the primary-air and secondary-air feeds.

The primary air can be supplied at 60 to 80% and preferably at about 70% of the total combustion air.

The secondary air can be supplied either parallel to the axis or swirled.

The primary air can be supplied parallel to the axis, swirled, or partly parallel to the axis and partly swirled.

The secondary air can be fed in in several portions one after the other at axial intervals parallel to the flow of the combustion gases.

The secondary air can be deflected outward as it emerges into the firebox.

The combustion gases that are drawn in can be cooled before being mixed with flame gases by spraying them with water.

The object is also attained in accordance with the invention by means of a burner of the aforesaid type, in which burner lances extend through a air box and are surrounded by a supply pipe with an entrance inside the air box and an exit in the mouth of the burner and in which another supply pipe is positioned inside the mouth of and along the axis of the burner, the burner being especially intended to carry out the aforesaid method and being characterized in that the second supply pipe is axially separated from the exit of the first supply pipe and is surrounded by a third supply pipe that is radially separated from the wall of the mouth of the burner and axially separated from the air box and in that an annular channel between the second and third supply pipe communicates with the air box through connecting pipes.

The connecting pipes can empty into an air-access chamber that communicates with the air box through an entrance that can be adjusted by means of a sliding drum.

The exit of the third supply pipe can extend toward the firebox beyond the exit of the second supply pipe.

The exit of the second supply pipe can on the other hand extend toward the firebox beyond the exit of the third supply pipe and have a diverting edge that points outward.

The exit of the third supply pipe can also extend to where the mouth of the burner meets the firebox.

The second supply pipe can have lateral bores.

There can be a section between the second and third supply pipe with its entrance cross-section upstream and its exit cross-section downstream of the exit cross-section of the second supply pipe with respect to the firebox.

The wall of the burner mouth can be surrounded by an annular chamber that has an air connection and is connected to the air box.

A swirl generator and an axially displaceable air duct can extend to the rear on the first supply pipe and the air duct can, when it is in one limiting position, block off the air intake to the swirl generator and, when it is in the other limiting position, the residual air intake to the first supply pipe.

There can be an annular connecting channel between the wall of the burner mouth and the third supply pipe with an annular line in it that has nozzles and conducts water.

Inside the air box there can be a cooling-air line with pipe connections that project into the connecting pipes.

The air box can be separated from the mouth of the burner by a cover plate, the cover plate can have an aperture in the vicinity of the annular connecting channel, and the aperture can be capable of being blocked off with a sliding drum inside the air box.

Thus, the combustion air is supplied in the method and burner in accordance with the invention in two or more stages through concentric channels with a succession of openings along the axis of the burner. The result is discontinuous mixture of the combustion air into the oil or gas flame in order to decelerate combustion, lower the temperature of the flame, and hence effectively suppress the formation of $NO_x$. The formation of $NO_x$ is further suppressed by recirculating the flue gas by means of an injection draft on the part of the flow of primary air. The flue gas is simultaneously removed from the firebox, where it is extensively burned up, in order to prevent coke caking and contamination. The high percentage of primary air generates and initial flame with enough ultraviolet radiation to allow the flame to be unobjectionably monitored by an ultraviolet photoelectric cell. The high percentage of primary air also increases the proportion of recirculated flue gas. The essential elements in the design of an oil and gas burner that have been proven in operation are, however, retained. The oil flame, for instance, must be stabilized in the potential turbulence behind a large enough impeller and the oil nozzles and gas lances can be positioned to ensure a stable and thoroughly ignited initial flame.

Some preferred embodiments of the invention will now be described with reference to the attached drawings, wherein

DETAILED DESCRIPTION OF THE PREFERRED EMBODIMENTS

Figure 1:
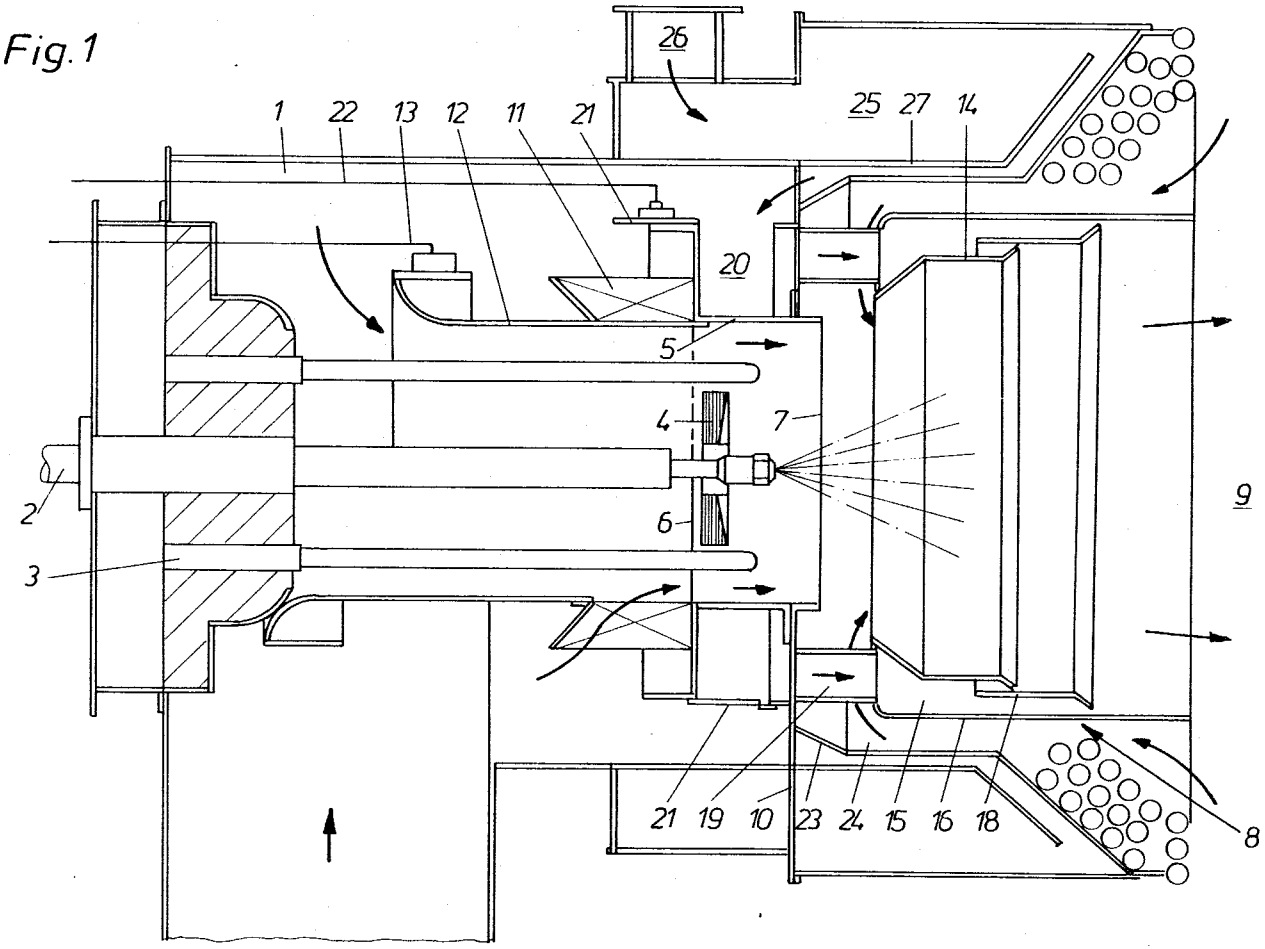
FIG. 1 is a longitudinal section through a burner in accordance with the invention and FIGS. 2 through 5 are longitudinal sections through the throat of various other embodiments of the invention.

The burner system consists of an air box 1 with a burner lance 2 for oil and several burner lances 3 for gas extending through it. Gas-burner lances 3 are positioned around oil-burner lance 2. An impeller 4 is attached to oil-burner lance 2.

Burner lances 2 and 3 are surrounded by a supply pipe 5 with an entrance 6 inside air box 1 and an exit 7 inside the mouth of the burner, which consists of a throat 8. Burner throat 8 opens into a firebox 9. Air box 1 is separated from throat 8 by a cover plate 10, through which supply pipe 5 extends.

A swirl generator 11 and an air duct 12 extend to the rear on the supply pipe 5. Air duct 12 can be axially displaced by means of a rod 13 that extends outside the burner. When it is in one limiting position, air duct 12 blocks off the air intake to swirl generator 11. When it is in the other limiting position, air duct 12 releases the air intake to swirl generator 11 and blocks off the residual air intake to supply pipe 5. The former position of air duct 12 is illustrated in the upper half of FIG. 1 and the latter in the bottom half. Positions intermediate to the two limiting positions are also possible.

A second supply pipe 14 is positioned inside throat 8 along the longitudinal axis of the burner and axially separated from the exit 7 of first supply pipe 5 and from the cover plate 10 on air box 1. Second supply pipe 14 preferably consists of a conically expanding section connected to a cylindrical section.

Figure 2:
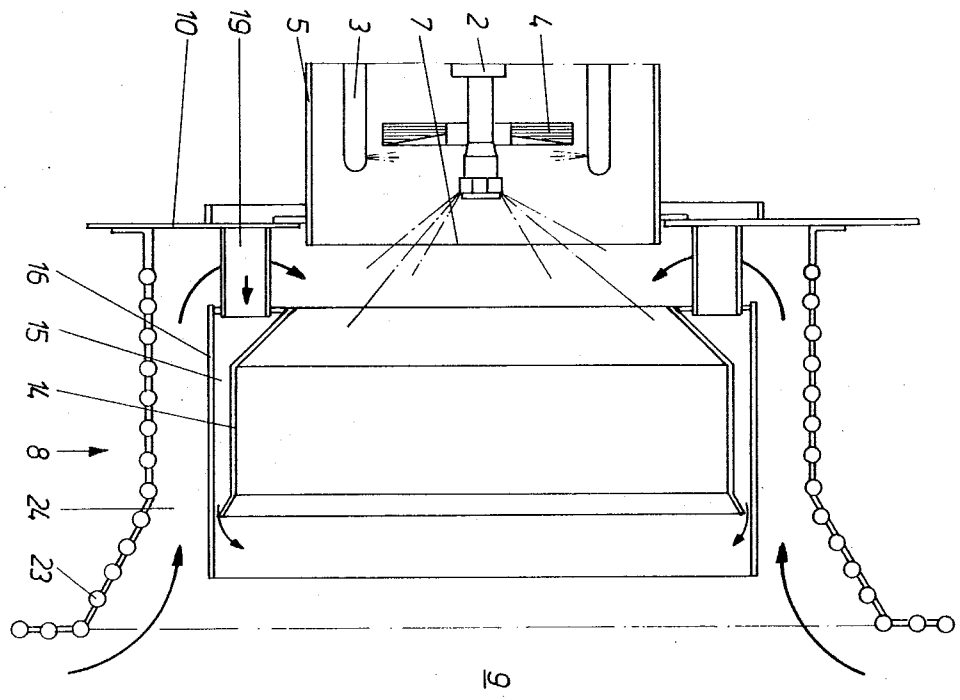

Second supply pipe 14 is surrounded inside throat 8 by a third supply pipe 16 in such a way as to leave space between the two pipes. Although third supply pipe 16 can, like pipes 5 and 14, be made out of metal, it can also, depending on the temperatures that are to be expected, be made out a fire-resistant ceramic material. Third supply pipe 16 can, as illustrated in FIG. 1, extend to where throat 8 meets firebox 9 or, as illustrated in FIG. 2, terminate just before that point. The exit cross-section of third supply pipe 16 is in either case nearer firebox 9 than the exit cross-section of second supply pipe 14 is.

Figure 4:
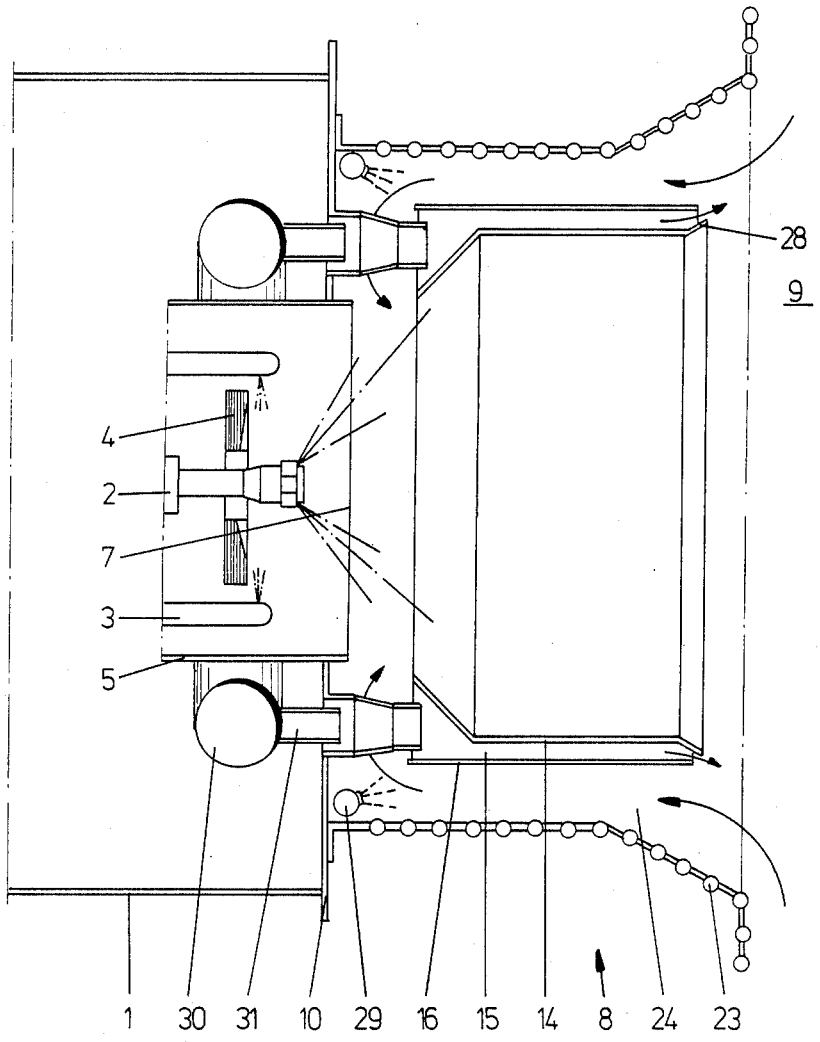

The second supply pipe 14 illustrated in FIG. 4 extends farther into throat 8 than third supply pipe 16 does. In this case second supply pipe 14 has a diversion edge 28 that points outward.

Figure 3:
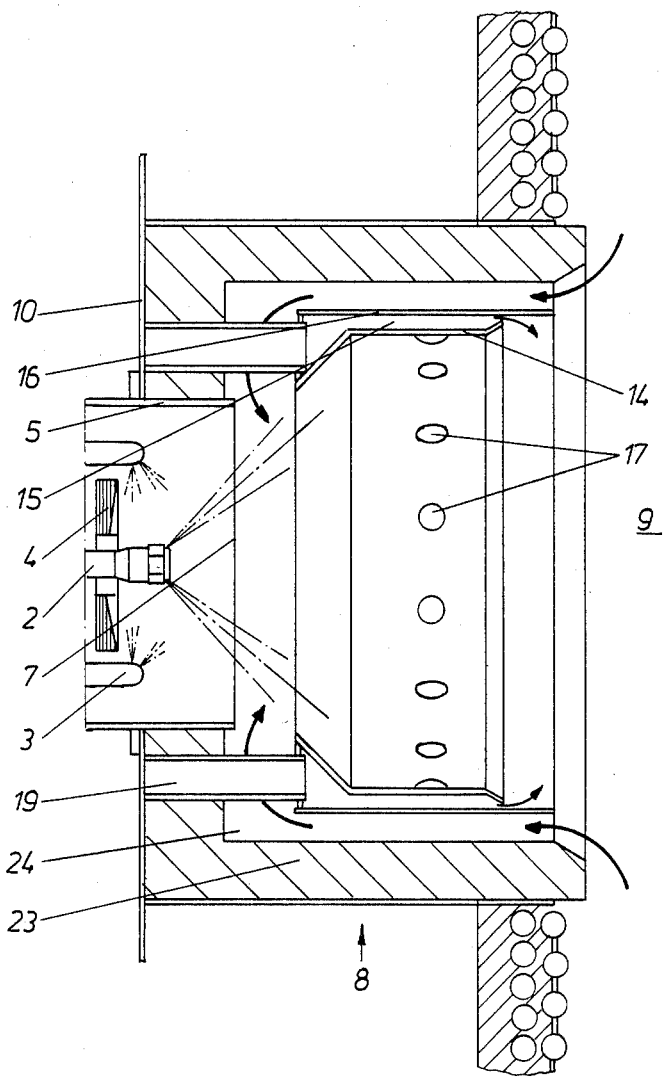

Second supply pipe 14 can, as illustrated in FIG. 3, have lateral bores 17 that allow communication between an annular channel 15 between pipes 14 and 16 and the inside of second supply pipe 14.

Second supply pipe 14 can also be extended by a section 18 that partly surrounds second supply pipe 14 inside third supply pipe 16. The entrance cross-section of pipe section 18 will then be upstream and its exit cross-section downstream of the exit cross-section of second supply pipe 14 with respect to firebox 9. Annular channel 15 will accordingly have two exit cross-sections, one downstream of the other.

The end of annular channel 15 facing air box 1 is closed. The channel communicates with air box 1 th rough connecting pipes 19. Connecting pipes 19 can empty into an air-access chamber 20 inside air box 1, into which it opens through an entrance. The entrance in air-access chamber 20 can be adjusted with a sliding drum 21 that can be axially displaced by means of a rod 22. Sliding drum 21 is illustrated at the top of FIG. 1 in the position in which it leaves the entrance to air-access chamber 20 free and at the bottom of FIG. 1 in the position in which it blocks it off.

In one simplified embodiment of the invention the connecting pipes empty directly into the air box. The embodiment accordingly lacks the air-access chamber with an entrance that can be blocked off by a sliding drum.

Third supply pipe 16 is radially separated from the wall 23 of throat 8 and axially separated from the cover plate 10 of air box 1, leaving an annular connecting channel 24 that connects firebox 9 with the inside of second supply pipe 14.

The wall 23 of throat 8 can, as illustrated in FIG. 2, consist of cooling pipes or, as illustrated in FIG. 3, be fire-proofed. The cooling-pipe version is to be recommended when the burner is connected to a once-through steam generator.

The wall 23 of the throat 8 illustrated in FIG. 1 is surrounded by an annular chamber 25. Annular chamber 25 is provided with an air connection 26. A booster fan supplies air to chamber 25 through connection 26. Annular chamber 25 is connected to air box 1. A bent sheet-metal deflector 27 that demarcates the sides of annular chamber 25 and is positioned at a distance from the wall 23 of throat 8 controls the flow of air that cools the wall.

Another potential accessory, illustrated in FIG. 4, is an annular line 29 connected to a source of water supply and positioned in the vicinity of cover plate 10 in annular connecting channel 24. Annular line 29 is equipped with nozzles that spray the water into channel 24.

Cooling air is blown through annular channel 15 when the burner is turned off to protect supply pipes 5, 14, and 16 and pipe section 18 from heat radiating from firebox 9 when the burner is off. Air box 1 accordingly accommodates a cooling-air line 30 supplied with cool air from outside the box. Cooling-air line 30 can also be in the form of a distribution box connected to the annular chamber 25 illustrated in FIG. 1 to cool the wall 23 of throat 8. Cooling-air line 30 is provided with pipe connections 31 that extend into connecting pipes 19. Cooling-air line 30 is supplied with air only when the burner is off.

Figure 5:
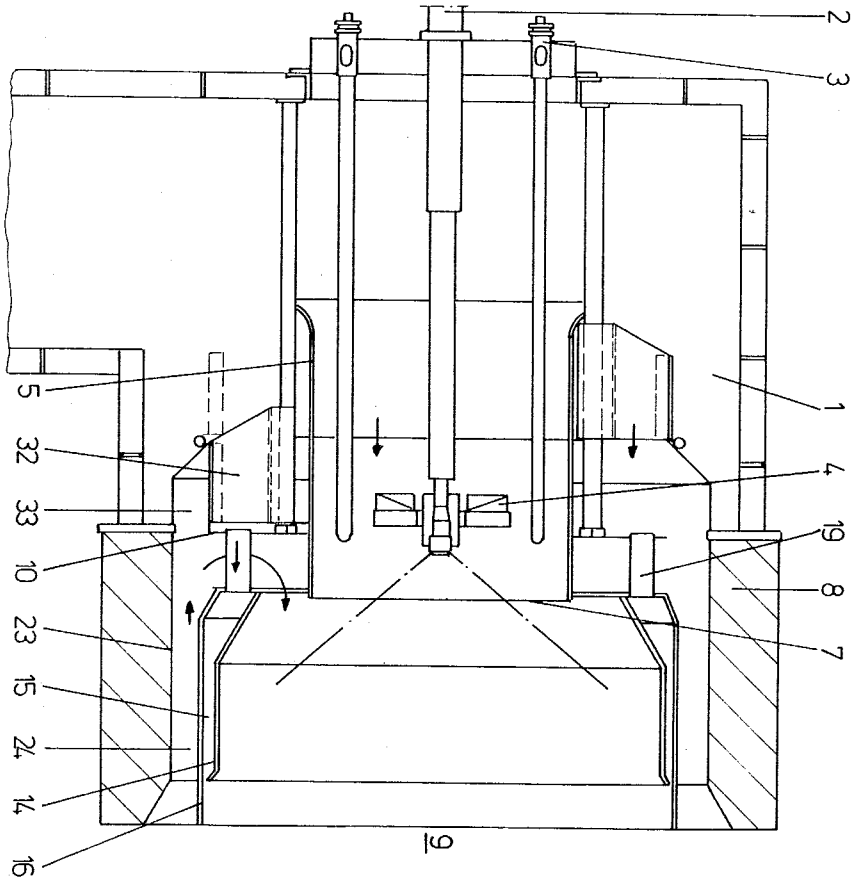

The embodiment illustrated in FIG. 5 can be operated either with air as a combustion medium by drawing combustion gas out of firebox 9 or with the exhaust gas from a gas turbine. The air or exhaust gas is supplied as desired to air box 1. A sliding drum 32 that can be displaced along the length of the burner is positioned in air box 1. The cover plate 10 that separates air box 1 from throat 8 has an annular aperture 33 as an extension of annular connecting channel 24.

Sliding drum 32 is illustrated at the bottom of FIG. 5 in the position assumed when the burner is operated with air as a combustion medium. In this position drum 32 blocks off annular aperture 33 and the injector effect of the primary air draws combustion gases out of firebox 9 through annular connecting channel 24 as previously described herein.

For operation with exhaust gas from a gas turbine sliding drum 32 is positioned as illustrated at the top of FIG. 5. In this position sliding drum 32 releases annular aperture 33 and exhaust gas can flow through first supply pipe 5 and annular channel 15 as well as through annular connecting channel 24. This provided the exhaust gas with a large enough flow cross-section.

The burner just described can be employed to carry out the method that will now be described.

A volume of air that has previously been determined in relation to the volume of gas is supplied to air box 1. Air volume is controlled by controls in the feed line. The combustion air is divided into primary air and secondary air in air box 1. The primary air flows through inner supply pipe 5 and burns the fuel emerging from oil-burner lance 2 or gas-burner lances 3 in a flame subject to less than stoichiometric conditions. The secondary air arrives through connecting pipes 19 in the annular channel 15 between second and third supply pipes 14 and 16. The secondary is then fed through the exit of second supply pipe 14 at an axial interval behind the primary air. The secondary air is, in the embodiments illustrated in FIGS. 1 and 2, again divided in second supply pipe 14 and supplied to the flame in a sequence of two stages.

In the embodiment illustrated in FIG. 4, the secondary air emerging from annular channel 15 is deflected outward, away from the flame, that is, by diversion edge 28. This further delays the mixture of secondary air with the flame gases.

The proportion of primary air in the total combustion air is higher than that of the secondary air, amounting to between 60 and 80% and preferably about 70%. The combustion air is portioned out by sliding drum 21 or by division in accordance with the dimensions of the flow-through cross-sections.

The primary air is supplied exclusively swirled, exclusively parallel to the axis, or partly swirled and partly parallel to the axis to the mouth of the burner, depending on the state of air duct 12. Since swirl generators can also be permanently positioned in the path of the secondary air, the secondary air can also be supplied either parallel to the axis or swirled.

The injector effect exerted by the primary air flowing out of first supply pipe 5 draws burned-out flue gases out of of firebox 9. The flue gases are supplied to the inside of second supply pipe 14 through annular connecting channel 24 and through the space between the entrance into second supply pipe 14 and the cover plate 10 of air box 1. Thus supplied, they arrive at the flame-initiation point between the primary-air and secondary-air feeds.

The flue gases that have been drawn in can be cooled before they are mixed with the flame gases inside second supply pipe 14. They can be cooled by water sprayed by annular line 29 into the flow of flue gases. Cooling prevents the temperature of the flame from increasing too much and contributes to a decrease in the formation of $NO_x$.

We claim:

1. Method of burning liquid or gaseous fuels in a firebox with reduced formation of $NO_x$, comprising the steps of: supply combustion air in portions or primary and secondary air; feeding said portions in one after the other at axial intervals parallel to flow of combustion gaees, said primary air generating an injector effector for drawing combustion gases in, said primary air being supplied at a percentage of the total combustion air that is higher than that of the secondary air; and drawing out extensively burned combustion gases from the firebox and conducting to a flame-initiation point between primary-air and secondaryrair feeds; said primary air being supplied swirled.

2. Method of burning liquid or gaseous fuels in a firebox with reduced formation of $NO_x$, comprising the steps of: supplying combustion air in portions of primary and secondary air; feeding said portions in one after the other at axial intervals parallel to flow of combustion gases, said primary air generating an injector effect for drawing combustion gases in, said primary air being supplied at a percentage of the total combustion air that is higher than that of the secondary air; and drawing out extensively burned combustion gases from the firebox and conducting to a flame-initiation point bstween primary-air and secondary-air feeds; said primary air being supplied partly parallel to the axis and partly swirled.

3. Method of burning liquid or gaseous fuels in a firebox with reduced formation of $NO_x$, comprising the steps of: supplying combustion air in portions of primary and secondary air; feeding said portions in one after the other at axial intervals parallel to flow of combustion gases, said primary air generating an injector effect for drawing combustion gases in, said primary air being supplied at a percentage of the total combustion air that is higher than that of the secondary air; and drawing out extensively burned combustion gases from the firebox downstream of the feeding of said secondary air and conducting to a flame-initiation point between primary-air and secondary-air feeds, so that said burned combustion gases produce a gaseous separating layer between said primary air and said secondary air, said gaseous layer being comprised of substantially inert combustion gas and delaying access of the secondary air to said flame-initiation point for delaying combustion with reduced formation of $NO_x$.

4. Burner for burning liquid or gaseous fuels with reduced formation of $NO_x$, comprising: a burner having a mouth; lances extending through an air box; a cover plate for separating said air box from said mouth; a first supply pipe surrounding said lances; said first supply pipe extending through said cover plate and having a entrance inside air box and an exit in said mouth of the burner; a second supply pipe positioned inside said mouth of said along an axis of said burner; said second supply pipe being axially separated from the exit of said first supply pipe and being surrounded by a third supply pipe that is radially separated from a wall of the mouth of the burner an axially separated from said cover plate of the air box; and an annular channel between the second and third supply pipe communicating with the air box through connecting pipes.

5. A method as defined in claim 3, wherein said primary air is supplied parallel to the axis.

6. Method as defined in claim 3, wherein the primary air is supplied at 60 to 80% of the total combustion air.

7. Method as defined in claim 3, wherein the secondary air is supplied parallel to the axis.

8. Method as defined in claim 3, wherein the primary air is supplied parallel to the axis.

9. Method as defined in claim 3, wherein the secondary air is fed in in several portions one after the other at axial intervals parallel to the flow of the combustion gases.

10. Method as defined in claim 3, and deflecting the secondary air outward as it emerges into the firebox.

11. Method as defined in claim 3, and cooling the combustion gases that are drawn in before being mixed with flame gases by spraying said combustion gases with water.

12. Burner as defined in claim 4, wherein said connecting pipes start from an air-access chamber communicating with air box through an entrance adjustable by a sliding drum.

13. Burner as defined in claim 4, wherein said third supply pipe has an exit extending toward the firebox beyond the exit of the second supply pipe.

14. Burner as defined in claim 4, wherein said second supply pipe has an exit extending toward the firebox beyond the exit of the third supply pipe and has a diverting edge pointing outward.

15. Burner as defined in claim 4, wherein said third supply pipe has an exit extending to the junction of the mouth of the burner and the firebox.

16. Burner as defined in claim 4, wherein said second supply pipe has lateral bores.

17. Burner as defined in claim 4, including a pipe section between the second and third supply pipe and having an entrance cross-section upstream and an exit cross-section downstream of the exit cross-section of the second supply pipe with respect to the firebox.

18. Burner as defined in claim 4, wherein the burner mouth has a wall surrounded by an annular chamber with an air connection and being connected to the air box.

19. Burner as defined in claim 4, including a swirl generator and an axially displaceable air duct extending to the rear on the first supply pipe, said air duct when in one limiting position blocking off the air intake to the swirl generator and when in other limiting position blocking off residual air intake to the first supply pipe.

20. Burner as defined in claim 4, including an annular connecting channel between the wall of the burner mouth and the third supply pipe, an annular line being arranged in said channel, said line having nozzles and conducting water.

21. Burner as defined in claim 4, including a cooling-air line inside the air box with pipe connections projecting into the connecting pipes.

22. Burner as defined in claim 4, including a cover plate separating the air box from the mouth of the burner, said cover plate having an aperture in the vicinity of the annular connecting channel, said aperture being blockable with a sliding drum inside the air box.

23. Method as defined in claim 3, wherein the primary air is supplied at substantially 70% of the total combustion air.

24. Method as defined in claim 3, wherein the secondary air is supplied in swirled form.

* * * * *